United States Patent [19]

Ruger et al.

[11] Patent Number: 4,742,635

[45] Date of Patent: May 10, 1988

[54] REVOLVER BARREL AND FRAME INCORPORATING INTEGRAL TELESCOPIC SIGHT MOUNTS

[75] Inventors: William B. Ruger, Croydon, N.H.; Lawrence L. Larson, Branford, Conn.

[73] Assignee: Sturm, Ruger & Company, Inc., Southport, Conn.

[21] Appl. No.: 794,027

[22] Filed: Nov. 1, 1985

[51] Int. Cl.[4] ..... F41G 1/38

[52] U.S. Cl. ..... 42/101; 42/75.03; 42/100; 33/245

[58] Field of Search ..... 42/1 ST, 1 A, 75 A, 42/75 B, 59, 71.01, 71.02; 33/245, 250

[56] References Cited

U.S. PATENT DOCUMENTS

| | | | |
|---|---|---|---|
| 226,923 | 4/1880 | Nogant | 42/71.01 |
| 3,303,594 | 2/1967 | Lewis | 42/59 |
| 3,611,606 | 10/1971 | Sefried et al. | 42/1 ST |
| 4,328,624 | 5/1982 | Ross | 42/1 ST |
| 4,341,022 | 7/1982 | Santoro | 33/250 |

*Primary Examiner*—Charles T. Jordan
*Assistant Examiner*—Michael J. Carone
*Attorney, Agent, or Firm*—Pennie & Edmonds

[57] ABSTRACT

A handgun having an elongated frame with a barrel seated against the frame and threaded to the frame in which the threads and seating surfaces are spaced apart a sufficient distance so that a telescopic recess mount means integral with the frame can be located therebetween without weakening the frame.

4 Claims, 4 Drawing Sheets

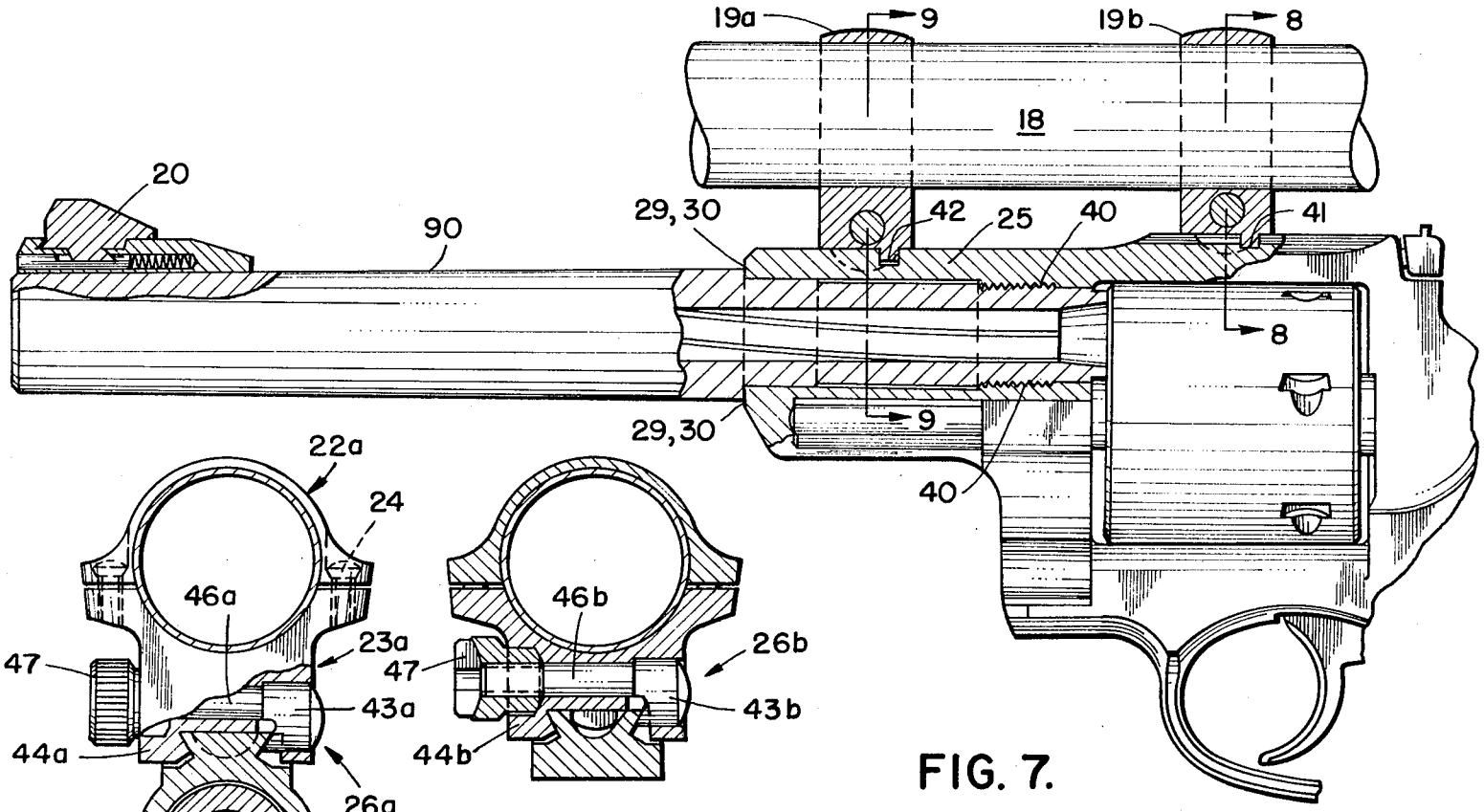
FIG. 7.
FIG. 8.
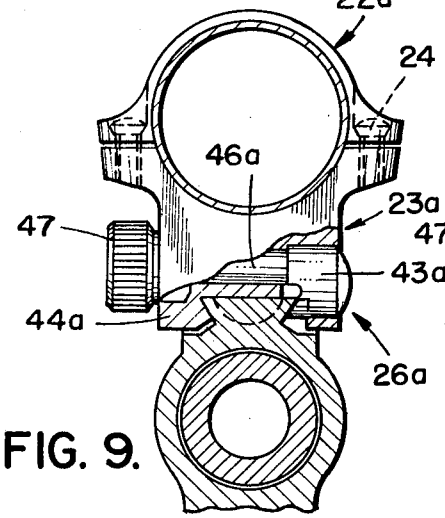
FIG. 9.

REVOLVER BARREL AND FRAME INCORPORATING INTEGRAL TELESCOPIC SIGHT MOUNTS

BACKGROUND OF THE INVENTION

Prior means for securing telescopic sights to handguns have included use of non-integral spaced-apart sight bases secured to the frame and the barrel. Such barrel and frame-mounted sight bases have necessarily included drilled and tapped screw holes in the barrel and frame for receiving mounting screws which in some instances could compromise desirable frame and barrel strength levels. Furthermore, the prior arrangements, which included a separate sight mount base attached to the firearm by screws and to which telescopic sight mounts were affixed have not proved entirely satisfactory since the separate base and its relatively small attaching screws are subject to loosening by recoil, vibration, and handling.

U.S. Pat. No. 4,531,321 discloses a clamp-type arrangement that fits over a revolver frame which arrangement is subject to loosening under recoil and the frame of the revolver depicted therein is not specifically machined to accept rigid scope mounts.

The arrangement depicted in U.S. Pat. No. 3,611,606, owned by the assignee of the present application, has been utilized by such assignee on revolver barrels but the results have not been entirely satisfactory due to the distance of the telescopic sight from the eye and the mass of the telescope and mounts located on the barrel. Furthermore, machining a rounded barrel to accept this prior patented system is difficult and costly. U.S. Pat. No. 3,611,606 discloses an arrangement for mounting a telescopic sight on a rifle receiver in which forward and rearward sight mounts engage accurate recesses integrally formed in the rifle receiver.

No prior revolver has yet incorporated an entirely suitable means for mounting barrel and a telescopic sight directly onto its frame without compromising strength and avoiding the problems associated with mounting such a sight with separate bases affixed to the frame via screws, or to mounts on the barrel.

SUMMARY OF THE INVENTION

Broadly, the invention comprises a handgun having a barrel threadedly engaged to the frame in which the shank frame portion of the frame is elongated to carry between (1) the seating surface of the barrel and frame shank and (2) the threaded sections of the barrel and frame, arcuate recesses for receiving a sight mount. The frame also has formed therein arcuate recesses rearward of the forward shank arcuate recess. The arcuate recesses which are integrally formed in the frame carry detachable scope mounts.

It is a feature of the invention that the frame shank is sufficiently elongated forwardly to provide spaces between the forward recesses, the threaded sections of the barrel and frame and the frame and shank seating surfaces so that the strength of the frame shank is not compromised in the vicinity of the scope mounting recesses in the frame.

It is an additional feature of this construction that a cylindrical barrel can be utilized without the need for complicated and expensive machine cuts on the barrel which would be required to accept the scope mounting system.

It is further a feature of this invention that during assembly barrels may be torqued tightly to the frame of the revolver without undue stress on the barrel threads, which, unlike any other revolver, do not extend forward along the barrel to the seating surface portion of the barrel which engages the front of the frame when the barrel is tightened in assembly.

BRIEF DESCRIPTION OF THE DRAWINGS

FIG. 7 is a sectional view taken along line 7—7 of FIG. 2;

FIG. 8 is a sectional view taken along line 8—8 of FIG. 7;

FIG. 9 is a sectional view taken along line 9—9 of FIG. 7;

DESCRIPTION OF THE PREFERRED EMBODIMENT

Figure 1:
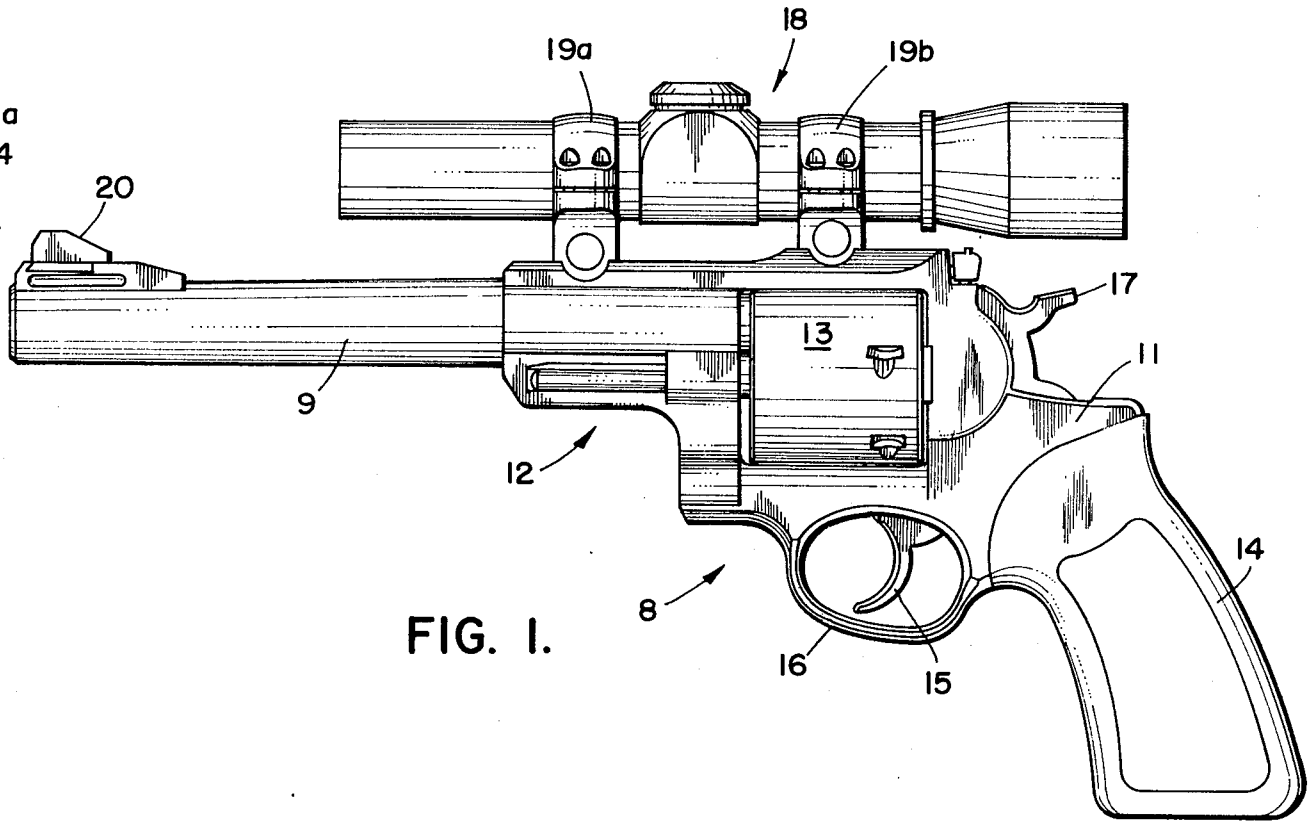
FIG. 1 is a left side elevational view of a revolver with elongated frame and scope mounts of the present invention.
Figure 2:
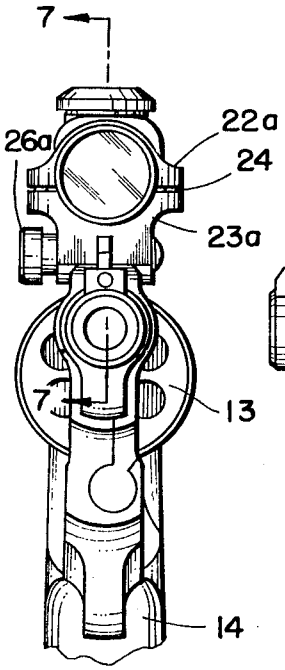
FIG. 2 is a front elevational view of the revolver.
Figures 3, 4, 5, 6:
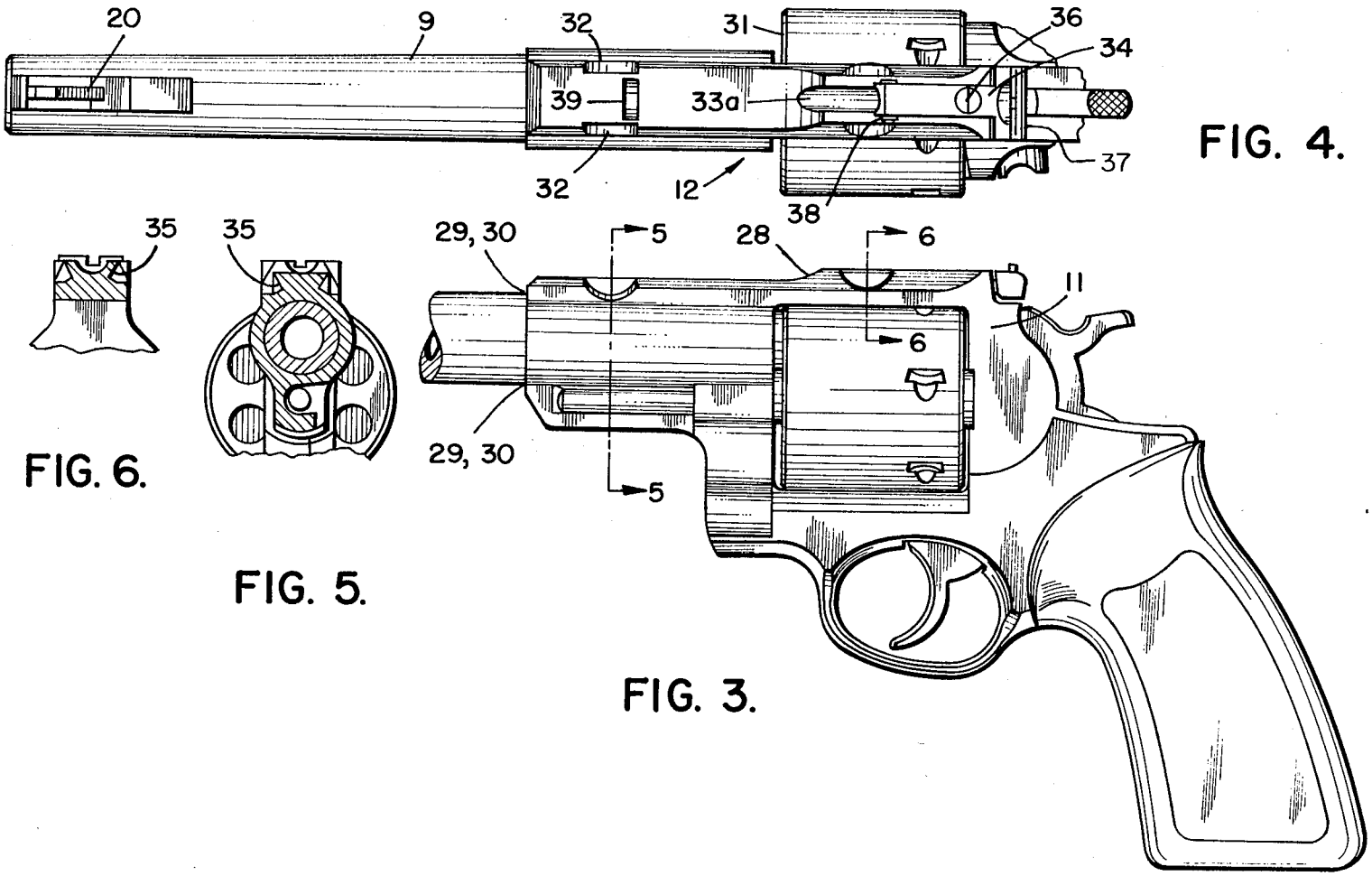
FIG. 3 is a partial left side elevational view of the revolver with the scope removed.
FIG. 4 is a plan view of the revolver with the scope removed.
FIG. 5 is a partial sectional view taken along line 5—5 of FIG. 3.
FIG. 6 is a partial sectional view taken along line 6—6 of FIG. 3.

In FIGS. 1 and 2, revolver 8 has a barrel 9, frame 11 including elongated frame shank portion 12, cylinder 13, handle 14, trigger 15, trigger guard 16 and hammer 17. Generally cylindrical telescope 18 is secured to revolver 8 through front scope mount **19*a* and rear scope mount 19*b*. Also shown is front sight 20**.

Each scope mount **19*a*, 19*b* includes an upper ring segment 22*a*, 22*b*; and a lower ring segment 23*a*, 23*b*. Upper and lower segments 22 and 23 are held together with screws 24 and lower segments 23 are secured to frame 11 by threaded lock keys 26*a*, 26*b*** as further described.

Turning to FIGS. 3–6, frame 11 includes integrally formed frame bridge 28; rearward scope base recesses 31 integrally formed in frame bridge 28 and forward scope base recesses 32 carried in frame shank portion 12. Recesses 31, 32 have inwardly sloping sides 35. Frame bridge 28 includes a longitudinal groove 33 for housing adjustable rear sight 34. Also included is a longitudinal sight clearance groove **33*a*. Sight 34 is adjustable in elevation by screw 36 and in windage by screw 37. Bridge 28 and frame shank 12 also have cross slots 38, 39 respectively for receiving mount recoil projections 41, 42 respectively (see also FIGS. 7 and 10). Barrel 9 has generally annular barrel seating surface 29 which is seated against generally annular frame shank seating surface 30**.

In FIGS. 7–9, the elongated shank frame 12 is shown carrying the forward scope mount **19*a* forward of the threaded sections 40 of the frame 11 and barrel 9. Spacing of seating surfaces 29, 30, recess pair 32, frame cross slot 39 and the threaded sections 40 prevent reduction in the strength in frame shank portion 12 even when stresses are formed in the seating surface area upon torquing during assembly of barrel 9 and frame shank 12. Through elongating shank 12 forwardly, the spacing between (1) seating surfaces 29, 30, (2) recesses 32 (and adjacent cross slot 39) and (3) the threaded sections 40 can be substantially increased for desired revolver frame and barrel strength. The spacing between seating surfaces 29, 30 and threaded sections 40 provide a shank portion 25 in which recesses 32** can be formed without compromising strength of the frame.

In FIGS. 8 and 9, each lock key 26 carries first frame gripper piece 43*a*, 43*b* and integral stem 46*a*, 46*b* threaded through second frame gripper piece 44*a*, 44*b*. Stems 46*a*, 46*b* carry thumb pieces 47. By turning thumb pieces 47 in one direction first and second gripper pieces 43*a*, 43*b*, 44*a*, 44*b* are urged together to grip the frame 11 or by turning the thumb piece 47 in the other direction gripper pieces 43*a*, 44*b* are moved apart to release the scope mounts 19*a*, 19*b*.

Figure 10:
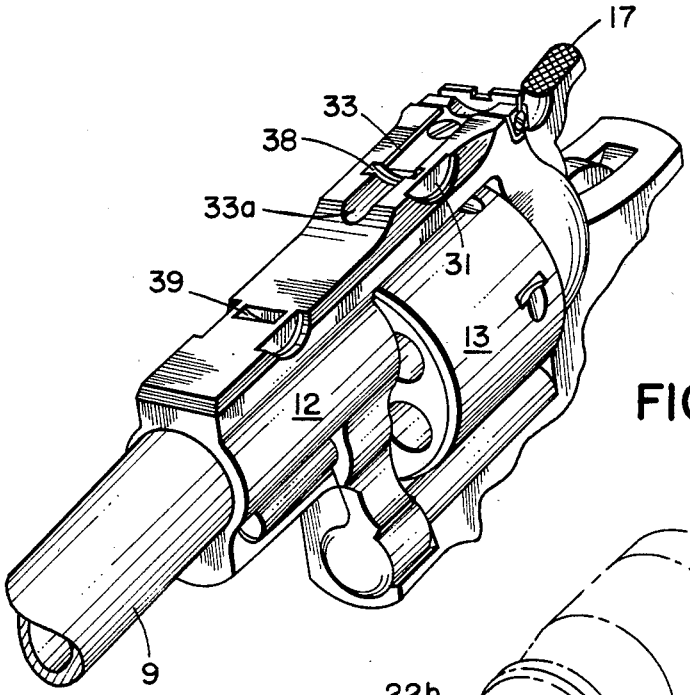
FIG. 10 is a partial perspective view of the revolver without the scope.
Figure 11:
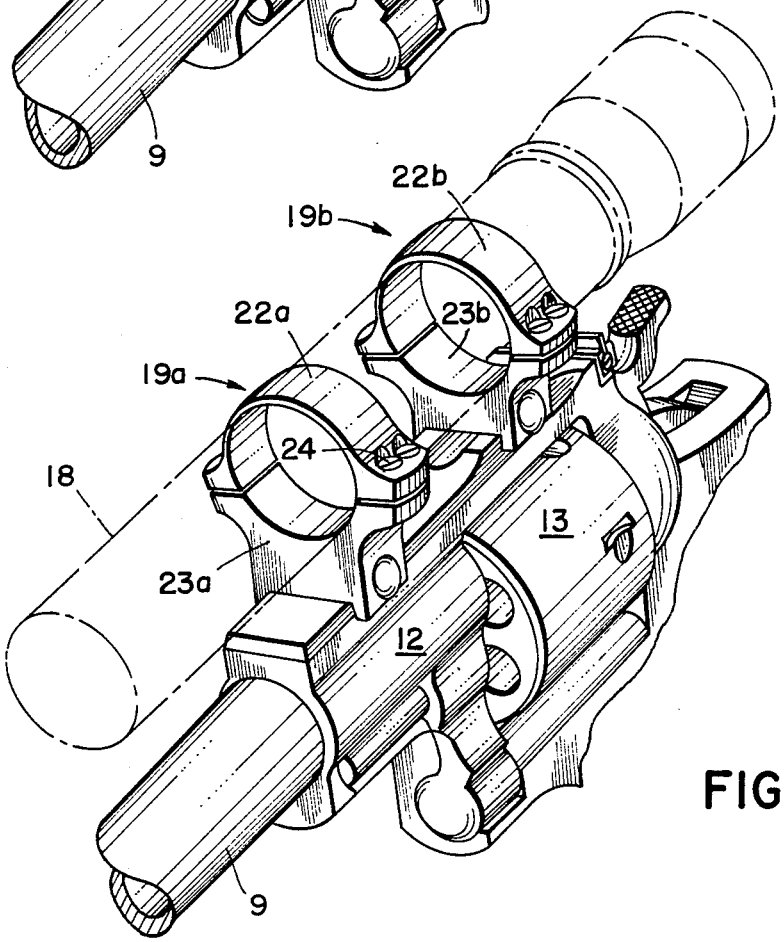
FIG. 11 is a partial perspective view of the revolver with the scope.

Finally with respect to FIGS. 10 and 11 the following parts are shown in perspective: barrel 9; shank frame portion 12; frame 11; frame bridge portion 28; cylinder 13; scope 18 and scope mounts 19*a*, 19*b*. Also shown are sight clearance groove 33*a*, recesses 31, 32 and cross slots 38, 39.

I claim:

1. A handgun having a frame and a barrel with a longitudinal axis threadedly engaged together comprising (a) the frame including an elongated frame shank integrally formed in the frame with a generally annular shank seating surface substantially perpendicular to the barrel axis at the forward end of the shank;

(b) telescopic mount recess means for mounting in the frame shank for carrying telescopic sights;

(c) the barrel carrying a generally annular seating surface substantially perpendicular to the barrel axis for engaging the shank seating surface;

(d) threaded sections on said barrel and such threaded sections extending along a longitudinal distance having a forward end and a rearward end, which longitudinal distance is substantially less than the distance between such threaded sections forward end and the annular shank seating surface frame; and (e) said threaded sections being located apart from the seating surfaces of said barrel and frame to form a frame portion capable of accommodating such mount recess means for telescopic sights in such a way that the strength of the barrel is not reduced due to the proximity of its threaded sections to the seating surfaces; nor is the strength of the frame reduced by the proximity of the telescopic mount recess means to the barrel threaded sections in the frame.

2. The handgun of claim 1 in which telescopic mount recess means is integrally formed in the frame shank.

3. The handgun of claim 1 having in addition a second rearward sight mount recess means integrally formed in the frame.

4. The handgun of claim 2 in which the recess means is a pair of recesses in the frame for receiving the sight mounts.

* * * * *